United States Patent [19]

Gillen, Jr.

[11] 4,431,347

[45] Feb. 14, 1984

[54] COMPOSITE TIMBER PILE SYSTEM

[76] Inventor: Gerard J. Gillen, Jr., 4512 Ithaca St., Metairie, La. 70002

[21] Appl. No.: 332,085

[22] Filed: Dec. 18, 1981

[51] Int. Cl.[3] ..... E02D 5/22; E02D 5/52

[52] U.S. Cl. ..... 405/251; 52/726; 403/306

[58] Field of Search ..... 405/251-256, 405/203-205, 195; 52/726; 403/306, 268

[56] References Cited

U.S. PATENT DOCUMENTS

| | | | |
|---|---|---|---|
| 684,044 | 10/1901 | Commons | 405/251 X |
| 1,079,375 | 11/1913 | Stange | 405/252 |
| 1,929,280 | 10/1933 | King | 405/250 |
| 3,720,068 | 3/1973 | De Rosa | 405/251 X |
| 3,802,206 | 4/1974 | Moore et al. | 405/251 |
| 3,924,413 | 12/1975 | Marsh | 405/251 |

FOREIGN PATENT DOCUMENTS

| | | | |
|---|---|---|---|
| 653017 | 5/1951 | United Kingdom | 405/251 |

*Primary Examiner*—Dennis L. Taylor
*Attorney, Agent, or Firm*—Charles C. Garvey

[57] ABSTRACT

A method of driving composite timber pile sections provides a pair of timber pile sections, the first of which is driven into the earth a distance leaving the butt of the pile exposed. A splice element is embedded into the remaining pile section and leveling material is added to the top of the first pile section. Upon assembly and during driving, the leveling material is laterally confined with the splice element while the respective mating surfaces of the two pile sections confine the leveling material vertically with the leveling material thus transferring compressive load between the two pile sections. In the preferred embodiment the splice element is a cylindrical element having a hollow inner bore which during operation contains the leveling material. An initially displaceable but later setting, non-displaceable material such as mortar (a mixture of cement, sand and water) could be used as the leveling material.

21 Claims, 11 Drawing Figures

12
14
15
16
17
30
31
32
34
35
36
38
40
42
20

COMPOSITE TIMBER PILE SYSTEM

BACKGROUND OF THE INVENTION

1. Field of the Invention

The present invention relates to piling and pile driving and more particularly relates to composite timber pile constructions and splice elements therefor. Even more particularly, the present invention relates to a composite timber pile construction and a method of driving composite timber piles in which a splice element confines a displaceable leveling material in a lateral direction with the leveling material transferring load evenly between the two piles spliced.

2. General Background

In various areas of the country where bearing pressures of soil are low and/or unsuitable for building purposes, construction can employ the use of one or more elongated load carrying elements referred to in the industry as a pile or piling. These devices for transferring load between a building and the underlying earth can be concrete, steel, or timber, in construction.

Timber piling are usually somewhat restricted in length because of the very nature of their source, namely trees. Thus it is desirable to splice timber piling together to form piling of extended length. These timber piling can also vary in diameter from end to end, complicating the splicing operation.

Often times timber pile are combined with piling of other construction such as, for example, concrete.

For example, in U.S. Pat. No. 3,003,323 issued to A. R. Holt provides a "Composite Pile Connector".

A "Pile Splicer" is also the subject of U.S. Pat. No. 3,802,206 issued to Robert Moore, et al. In that patent a splicing means for connecting two wood piles end to end to make a long pile for the transfer of pile loads to a lower stronger ground is disclosed. The splicer in that patent provides a plate-like, substantially horizontal element adapted to lie between adjacent pile ends. Optional epoxy glue between the upper and lower surfaces can be provided of the element and the upper and lower piles. A central upright dowel member extends above and below the plate-like element driven into each pile element respectively.

A "Composite Pile and Method of Manufacture" is the subject of U.S. Pat. No. 4,252,473 issued to Albert M. Thomas, et al. The composite section includes a wooden section and a helically corrugated shell secured to the wooden section by a transition fitting.

A composite concrete and timber pile is the subject of U.S. Pat. No. 1,471,124 entitled "Means for Connecting Ferro or Reinforced Concrete Piles to Wooden Piles".

"Composite Piles and Joiners Therefor" is the subject of U.S. Pat. No. 2,912,829 issued to W. H. Cobi. The Cobi patent shows a composite concrete and timber pile with a splice element therefor.

A "Method and Apparatus for Splicing Replacement Pile Sections to a Pile Stub" is the subject of U.S. Pat. No. 3,720,068 issued to E. R. DeRosa.

A splice element for two wooden utility poles, for example, is provided in U.S. Pat. No. 4,032,244. The extension would be attached to the flatten top of an existing pole. A projecting center shaft extends from the bracket to be received within mating center bores provided in the utility pole, a wooden extension pole or both. Threaded fasteners and metal straps complete the interconnection between the existing pole and the extension pole.

A "Pile Coupling and a Method of Pile Driving" is seen in U.S. Pat. No. 3,762,173 issued to Richard Marsh. The patent discloses a means for coupling sections of pile and a method of driving pile utilizing a thin-wall composite pile section. The coupling comprises a thin-wall sleeve with a telescoping thick-wall ring or collar mechanically anchored within the sleeve. Taps integrally formed in the collar, or the entire collar itself, are expanded within the sleeve to form corresponding anchor pots in the sleeve thereby mechanically interlocking the collar and sleeve. The coupling is adapted for use in coupling successive sections of thick-wall tubular pile or in coupling thin-wall tubular composite pile or thick-wall tubular pile. Use of the thin-wall tubular composite pile enables employment of a method for driving pile which eliminates the necessity for retaining a succeeding thick-wall tubular pile after the initial one is driven home.

The above devices fail to provide a suitable means for effective transfer of load between two timber pile in a manner which is simple, straightforward, easy to use, easy to field erect, easy to duplicate with good load carrying consistency, and easy to adapt to partial shop assembly, providing partial assembly when weather prevents pile driving such as rain, and the like.

In attempting to prepare a composite pile construction of two timber pile sections, invariably, the ends of the pile provide cut surfaces which may have been the result of a crude cutting arrangement such as a chainsaw or the like. The chances of both pile surface which abut upon assembly being exactly face to face is slim thus preventing the effective transfer of load from one pile to the other. This produces point stresses and can introduce bending moment into the entire assembly of the two pile sections. Such introduction of bending moment into the pile can cause buckling of the entire pile assembly and thus failure upon driving. Indeed, angular misalignment between the two pile sections reduces its effective load carrying capabilities.

Another problem in the assembly of two timber pile sections in a composite fashion is vertical alignment. The two timber pile sections must be vertically aligned and kept vertically aligned during driving so that the shock applied to the entire assembly by a hammer or other driving means does not cause the two piles to shift preventing effective load transfer from the top pile to the bottom pile section.

A composite section of two timber piles should be cost effective. It would be desirable to have an economical composite pile assembly doing away with the need for a concrete and timber pile construction having a timber pile topped with a concrete cap as is often used in the prior art.

Discussion of the Present Invention

The present invention thus provides a method of driving composite timber pile sections in which there is provided a pair of timber pile sections with the first piling being driven into the earth a distance leaving an unexposed end portion.

A splice element is embedded partially into the second pile section and leveling material which is displaceable is added to the top of the first pile section. The leveling material is confined laterally within the splice element inside a provided bore with the bore communicating upon assembly with both pile sections trapping the leveling material. The pile sections are axially aligned and driven with the splice element then embedding into the second pile section. The leveling material is confined vertically by the respective mating faces of the two pile sections. The compressive load between the two pile sections is thus transferred through the leveling material and distributed evenly over the faces of the two piles.

The splice element is preferably cylindrical having a hollow inner bore. The leveling material should have good load carrying capability and is preferably displaceable and can be granular, for example, such as sand. The splicing element can have an indexing means for limiting the penetration of the stop element in each direction into each respective pile section. The pile sections are preferably flat on each end providing cooperating substantially flat mating surfaces which abut respectively the interfaced leveling material.

Thus, it is an object of the present invention to provide a method and apparatus of driving composite timber pile sections in which an entirely timber pile of composite construction is provided with effective load transfer therebetween.

Another object of the present invention is to provide a method of driving composite timber pile sections in which load is equally and evenly transferred between the two pile sections.

Another object of the present invention is to provide a method of splicing and of driving composite timber pile sections of differing diameters.

Another object of the present invention is to provided a method and apparatus of driving composite timber pile sections which is easy to adapt to field driving and assembly.

It is another object of the present invention to provide a method of driving composite timber pile sections which adapts itself easily to partial shop assembly/construction during weather conditions which prohibit pile driving.

Another object of the present invention is to provide a method of driving composite timber pile sections which is easy to use, easy to repeat with precision, and requires a minimum of personnel for handling.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PRESENT INVENTION

FIGS. 1 through 6 illustrate the preferred embodiment of the method and apparatus of the present invention.

Figures 1, 2, 3, 4, 5, 6:
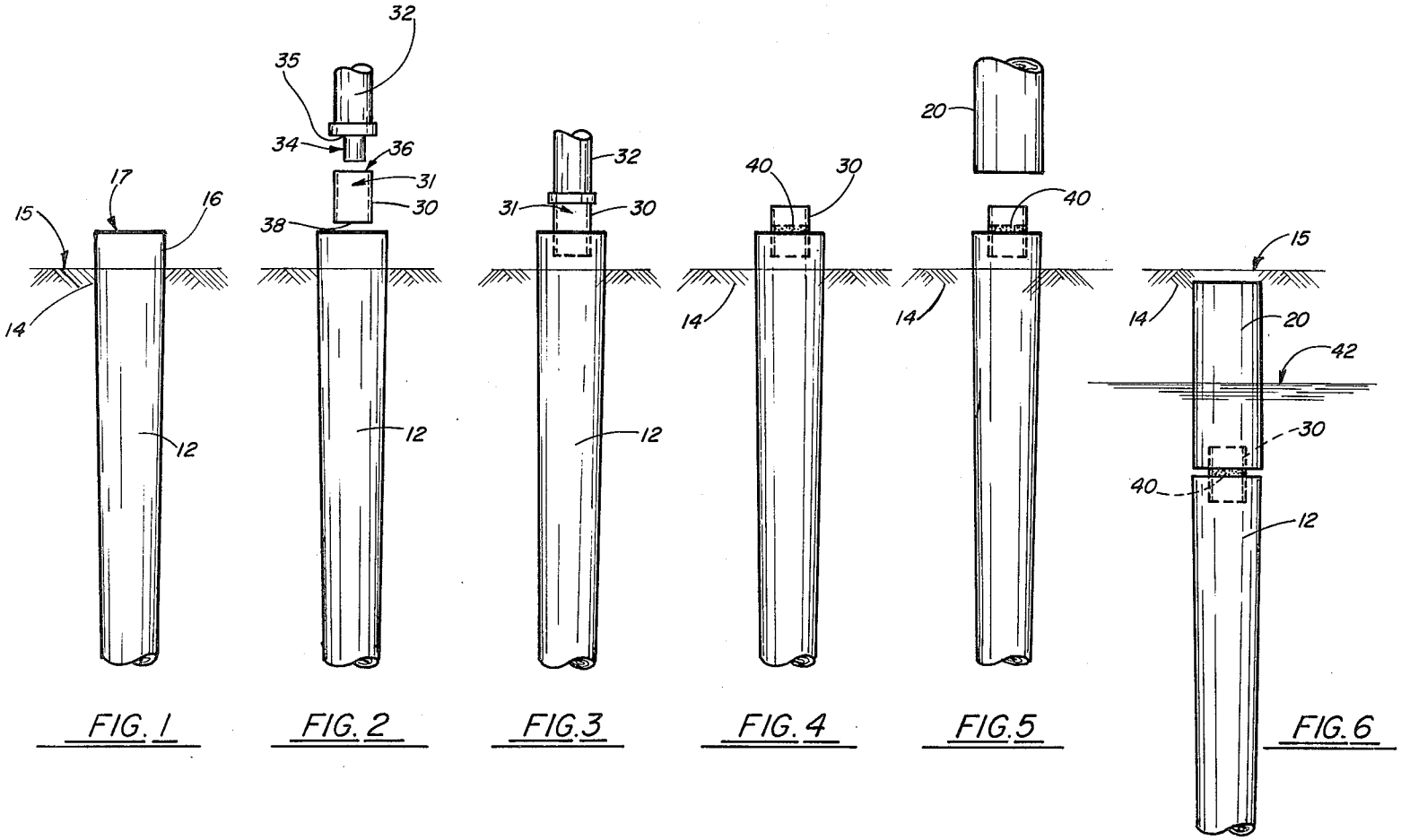
FIGS. 1–6 are sequential views of the preferred embodiment of the apparatus of the present invention illustrating the method of driving composite timber piles of the present invention.

In FIG. 1 there can be seen a first, lowermost pile section 12 which has been driven a distance into the earth 14 below the earth's surface 15 a desired distance leaving an exposed uppermost butt 16. The butt 16 provides a substantially flat upper surface 17 which is perpendicular to the longitudinal axis of the pile 12.

A second pile section 20 is also provided which will be spliced with pile 12 using splice element 30 as will be described more fully hereinafter.

Notice that in the embodiment of FIGS. 1 through 6, splice element 30 is first driven a distance into pile 12 using a ram 32 having a tip 34 which registers with the inner bore of splice element 30. Ram 32 provides a shoulder 35 which will abut the upper surface 36 of splice element 30 during the embedding of splice element 30 into pile 12. This can be seen best in FIG. 3 where splice element 30 has been driven approximately half its length into the upper surface 17 of pile 12.

After splice element 30 has been added by partially embedding it into one of the pile sections, a leveling material of granular substance, for example, such as sand is added to the top of the first pile section. The leveling material occupies the bore 31 of splice element 30 and thus is confined laterally by the splice element. The granular leveling material 40 is seen in FIGS. 4, 5, and 6. Second pile section 20 is axially aligned with pile 12 and the remaining portion of splice element 30 is embedded thereinto with the composite pile section driven into the earth the desired distance as shown in FIG. 6. Note that water table 42 indicates that the uppermost pile section 20 could be treated while pile section 12 could be untreated since it is below the water table 42.

The construction of splice element 30 can be seen more particularly in FIGS. 7 through 11.

Figure 7:
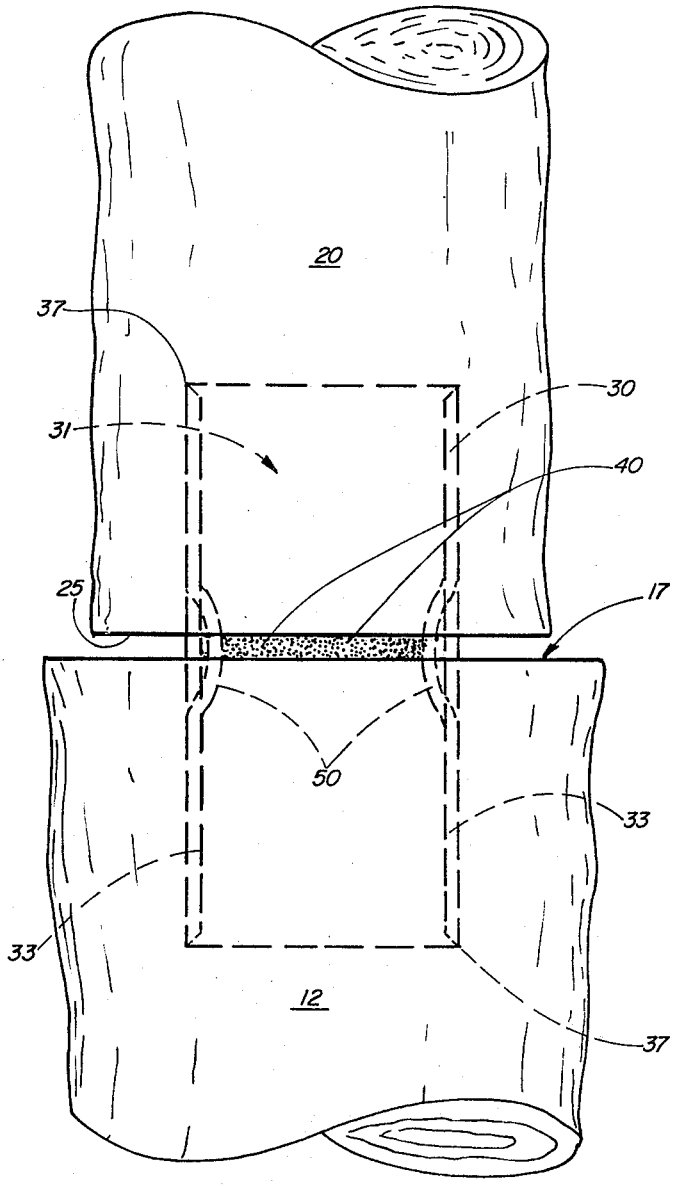
FIG. 7 is a sectional view of the preferred embodiment of the apparatus of the present invention.

Note in FIG. 7 upper and lower pile sections 20, 12 respectively with splice element 30 in position. Note that leveling material 40 is confined laterally by the continuous curved sidewall 33 of splice element 30 thus preventing lateral escape of granular leveling material 40 as would be undesirable. By laterally confining leveling material 40, it can thus act as an effect load transfer in a vertical direction between pile section 12 and pile section 20. Each pile section provides a mating face portion with pile 12 providing uppermost face 17 and with pile section 20 providing a downwardly facing face 25. Each mating face 17, 25 respectively is substantially flat and generally perpendicular to the longitudinal axis of the pile section 12, 20 involved.

Figure 8:
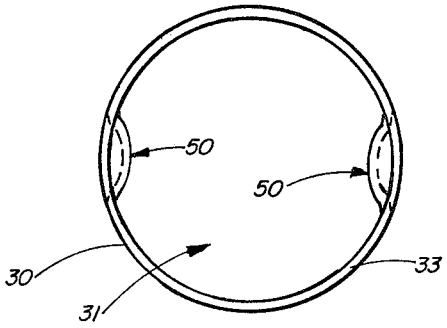
FIG. 8 is a top view of the preferred embodiment of the apparatus of the present invention.
Figure 9:
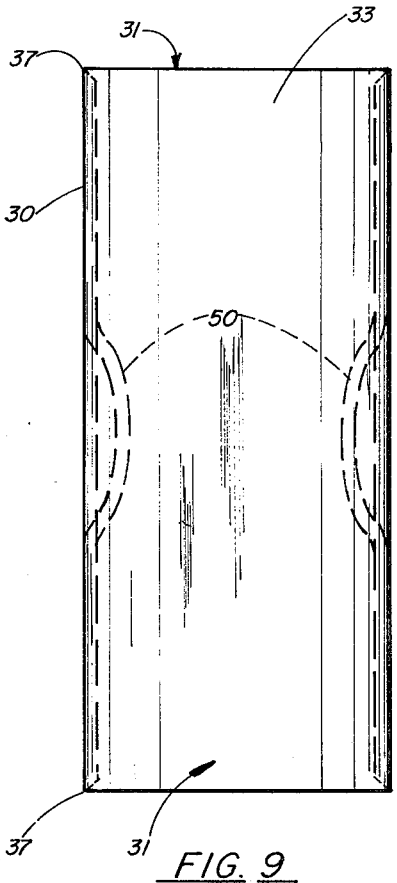
FIG. 9 is a partial elevational view of the preferred embodiment of the apparatus of the present invention.

Splice element 30 also provides one or more indexing dimples as best seen in FIGS. 7 and 8, each of which is indicated by the numeral 50. Each dimple 50 is merely a concave depression formed in wall 33 with two dimples 50 being shown in FIG. 8 spaced approximately one hundred eighty (180°) degrees apart. It should be understood that two, three or four dimples 50 could be provided as indexing means.

Figure 10:
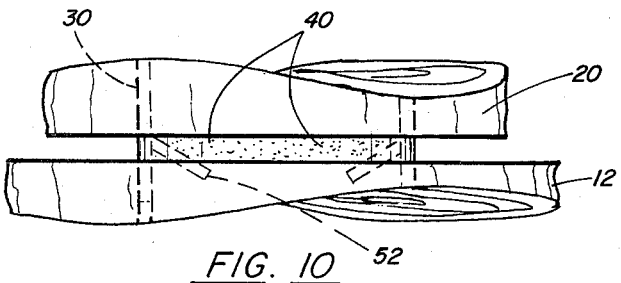
FIGS. 10–11 are alternate embodiments of the preferred embodiment of the apparatus of the present invention illustrating alternate splice elements therefor.
Figure 11:
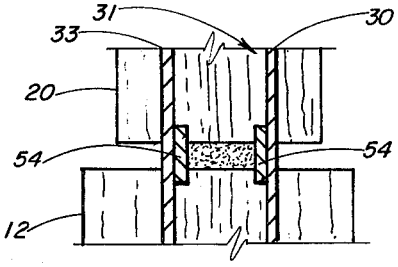

FIGS. 10 and 11 show alternate embodiments of the indexing means with FIG. 10 showing inwardly projecting plates 52 and FIG. 11 showing a pair of longitudinal bars 54 which would be attached to wall 33 by welding, for example.

Splice element 30 would be manufactured of any suitable structural material such as steel or the like and would have beveled edges 37 which would provide a cutting means for enhancing the penetration of upper surface 36 and lower surface 38 of each end of splice element 30 into pile sections 12, 20.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of driving a composite timber pile section of a pair of connected timber pile sections having corresponding transverse mating faces comprising the steps of:

a. driving a first, lowermost pile section into the earth a distance, leaving one of the mating faces exposed;
b. partially embedding a bottom portion of a splice element into one of the pile sections so that the splice element cuts into the pile;
c. adding displaceable leveling material to one of the pile section mating faces;
d. laterally confining the displaceable leveling material with the splice element;
e. axially aligning the two pile sections;
f. partially embedding the top portion of the splice element into the second upper pile section; and
g. driving the composite pile section into the earth.

2. The method of claim 1 wherein in step (b) the splice element is cylindrical, having a hollow open-ended inner bore.

3. The method of claim 1 wherein in step (c), the leveling material is added to the splice element bore.

4. The method of claim 1 wherein in step (b) the splice element has an indexing means for limiting penetration of the stop element into each pile section.

5. The method of claim 1 wherein the treated pile section is creosote timber.

6. The method of claim 1 wherein each pile section is trimmed before splicing to provide cooperating substantially flat mating surfaces, and in step (e) the mating surfaces are interfaced by the granular leveling material.

7. The method of claim 1 wherein in step (c) the leveling material is granular.

8. The method of claim 1 wherein the splice element is embedded into the second pile section prior to driving the two pile assembly.

9. The method of claim 1 wherein one of the pile sections is treated and the other is untreated.

10. The method of claim 9 wherein the first, lowermost pile section is untreated.

11. A drivable, composite timber pile apparatus comprising:

a. a first, lowermost timber pile section;
b. a second, uppermost timber pile section, positioned axially above the first timber pile section, each of the pile sections providing a longitudinal axis, and cooperating transverse mating faces generally perpendicular thereto;
c. a closed wall splice element with an inner bore which has a maximum lateral dimension smaller than the lateral dimension of the pile sections so that the splice element projects longitudinally into each of the timber pile elements a distance; and
d. a mass of displaceable leveling material disposed between the mating faces and within the bore upon assembly, so that the mating faces of the pile sections and the splice element combine to confine the leveling material during driving.

12. The apparatus of claim 11 further comprising indexing means on the splice element for defining the degree of penetration of the splice element into each of said timber pile sections.

13. The apparatus of claim 11 wherein the splice element is cylindrical.

14. The apparatus of claim 12 wherein the indexing means is at least one lateral projection affixed to the splice element.

15. The apparatus of claim 11 wherein the leveling material is a granular substance.

16. The apparatus of claim 11 wherein the leveling material is sand.

17. The apparatus of claim 11 wherein the axis of each pile section and the axis of the splice element bore are coaxial.

18. The apparatus of claim 11 wherein one of the pile sections is treated and one is untreated.

19. The apparatus of claim 13 wherein the splice element provides spaced apart upper and lower beveled cutting edges.

20. The apparatus of claim 11 wherein the mass of leveling material is displaceable during driving, but later sets to form a hard non-displaceable interface between the pile sections.

21. The apparatus of claim 20 wherein the leveling material is mortar.

* * * * *